US009970721B1

(12) United States Patent
Oglesby

(10) Patent No.: US 9,970,721 B1
(45) Date of Patent: May 15, 2018

(54) CAM PIN

(71) Applicant: Paul Oglesby, Darley (GB)

(72) Inventor: Paul Oglesby, Darley (GB)

( * ) Notice: Subject to any disclaimer, the term of this patent is extended or adjusted under 35 U.S.C. 154(b) by 6 days.

(21) Appl. No.: 14/855,766

(22) Filed: Sep. 16, 2015

Related U.S. Application Data

(60) Provisional application No. 62/051,816, filed on Sep. 17, 2014.

(51) Int. Cl.
*F41A 3/00* (2006.01)
*F41A 3/26* (2006.01)
*F41A 3/66* (2006.01)

(52) U.S. Cl.
CPC . *F41A 3/26* (2013.01); *F41A 3/66* (2013.01)

(58) Field of Classification Search
CPC ..... F41A 3/16; F41A 3/20; F41A 3/26
See application file for complete search history.

(56) References Cited

U.S. PATENT DOCUMENTS 3,368,298 A * 2/1968 Browning ..... F41A 3/26 42/16
3,648,562 A * 3/1972 Loeble ..... F41A 19/13 89/148
6,609,319 B1 * 8/2003 Olson ..... F41A 3/26 42/16
8,863,638 B2 * 10/2014 Lewis, III ..... F41A 3/68 42/16
2010/0319527 A1 * 12/2010 Giefing ..... F41A 3/26 89/185
2017/0074607 A1 * 3/2017 Lewis ..... F41A 3/26

* cited by examiner

*Primary Examiner* — Gabriel Klein
(74) *Attorney, Agent, or Firm* — Shaddock Law Group, PC

(57) ABSTRACT

A cam pin having a cam pin shaft, wherein said shaft extends from a terminal end surface, along a longitudinal axis, to a shoulder; a firing pin aperture formed through said cam pin shaft; and a head, wherein said head extends from said shoulder, along said longitudinal axis, to a crown, wherein a surface of said crown is finished with a substantially smooth surface.

7 Claims, 12 Drawing Sheets

CAM PIN

CROSS-REFERENCE TO RELATED APPLICATIONS

This patent application claims the benefit of U.S. Provisional Patent Application Ser. No. 62/051,816, filed Sep. 17, 2014, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, the applicant owns all trademarks and service marks identified herein.

BACKGROUND OF THE INVENTION

1. Field of the Invention

The present disclosure relates generally to the field of firearms. More specifically, the present invention relates to an enhanced cam pin for gas-operated firearms.

2. Description of Related Art

A number of firearms operate based on a gas blowback system. One such firearm is the M-16, M-4, and AR-15 family of firearms. The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylindrical gas aperture 42 between the bolt carrier 20 and the bolt 30 and drives the bolt carrier 20 rearward.

The buffer, which is pushing on the rear of the bolt carrier group 10, is forced rearward by the bolt carrier group 10 compressing the recoil spring. During this rearward movement, a cam pin track or slot 22 in the upper portion of the bolt carrier 20 acts on the bolt cam pin 50, translating the rearward linear movement of the carrier into rotational movement, thereby rotating the cam pin and bolt 30 clockwise so that the bolt locking lugs are unlocked from the barrel extension locking lugs. As the rearward movement of the bolt carrier group 10 continues, the empty cartridge case is extracted from the chamber, and ejected through the ejection port.

As the bolt carrier group 10 clears the top of an inserted magazine and the empty cartridge case is expelled, a new round is pushed into the path of the bolt 30 by the upward thrust of the magazine follower and spring.

As the bolt carrier group 10 continues to move rearward, it overrides the hammer and forces the hammer down into the receiver, compressing the hammer spring, and allowing the rear hook of the hammer to engage with the hammer disconnect.

When the bolt carrier group 10 reaches its rearmost position (when the rear of the buffer contacts the rear of the buffer tube), the compressed recoil spring expands, driving the buffer assembly forward with enough force to drive the bolt carrier group 10 forward, toward the chamber, initiating chambering of the waiting round from the magazine into the chamber.

The forward movement of the bolt 30 ceases when the locking lugs pass between the barrel extension locking lugs and the round is fully chambered. When the bolt carrier 20 enters the final portion of its forward movement, the bolt cam pin 50 emerges from the cam pin guide channel in the upper receiver and moves along the cam track, rotating the bolt 30 counterclockwise. This rotation locks the bolt 30 to the barrel extension (by interaction of the bolt locking lugs and the barrel extension locking lugs). The locking of the bolt 30 completes the cycle of operation and, when the trigger is released, the rear hammer hook hammer slips from the disconnect and the front hammer hook is caught by the sear of the trigger. The firearm is then ready to be fired again.

Unfortunately, as this cycle occurs, certain portions of the head of the standard cam pin 50 make contact with various surfaces within the upper receiver. The friction created by the contact causes cam pin wear and/or gouging of the inner surface of the guide channel and other interior surfaces of the upper receiver. Over time, this wear or gouging can impair the integrity of the upper receiver and/or the firearm's ability to cycle reliably.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

The typical cam pin geometry and arrangement has various shortcomings. Thus, the features and elements of the presently disclosed cam pins provide various cam pins that overcome the shortcomings of the standard cam pin and provide improved, enhanced cam pins.

In various exemplary, non-limiting embodiments, the cam pin of the present disclosure includes a cam pin shaft, wherein said shaft extends from a terminal end surface, along a longitudinal axis, to a shoulder; a firing pin aperture formed through said cam pin shaft; and a head, wherein said head extends from said shoulder, along said longitudinal axis, to a crown, wherein a surface of said crown is finished with a substantially smooth surface.

In various exemplary, non-limiting embodiments, the cam pin of the present disclosure includes a substantially cylindrical shaft element; a substantially cylindrical pivot shaft extending from the shaft element; a firing pin aperture formed through the cam pin shaft element, and a head element, wherein the head element extends from a terminal surface, along a longitudinal axis of the head element, to a cam pin crown, wherein a surface of the cam pin crown is substantially smooth, and wherein a crown aperture is formed through a center of the head element, along the longitudinal axis of the head element, wherein the crown aperture is formed so as to allow at least a portion of the pivot shaft to pass therethrough, such that the head element is able to freely rotate atop the shaft element, via interaction of the pivot shaft and the crown aperture.

In various exemplary, non-limiting embodiments, the present disclosure includes an enhanced upper receiver, comprising an enhanced cam pin rotation groove; and an enhanced rotation groove corner, wherein the enhanced cam pin rotation groove corner is radiused so as to provide a smooth transitional surface between the enhanced rotation groove.

Accordingly, the presently disclosed invention provides a cam pin that operates without producing significant wear on the interior of the upper receiver.

The presently disclosed invention separately provides a cam pin that does not present any sharp edges to the interior of an upper receiver.

The presently disclosed invention separately provides a cam pin that can be retrofitted to an existing bolt or bolt carrier group without modification to the bolt carrier or the bolt carrier key.

The presently disclosed invention separately provides a cam pin that can be easily installed by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the invention discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the invention that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present invention.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF EXEMPLARY EMBODIMENTS OF THE INVENTION

Figure 1:
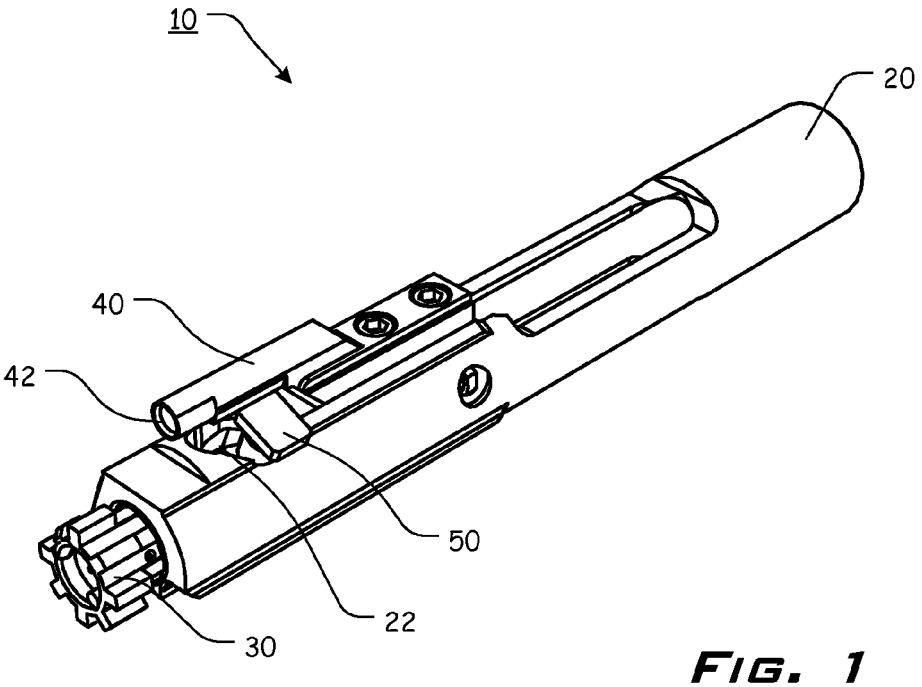
FIG. 1 PRIOR ART
FIG. 1 illustrates a perspective view of a standard bolt carrier group utilizing a standard cam pin.
Figure 2:
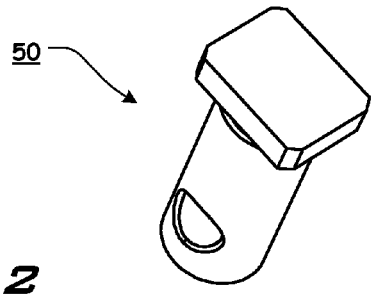
FIG. 2 PRIOR ART
FIG. 2 illustrates a perspective view of a standard cam pin.
Figure 3:
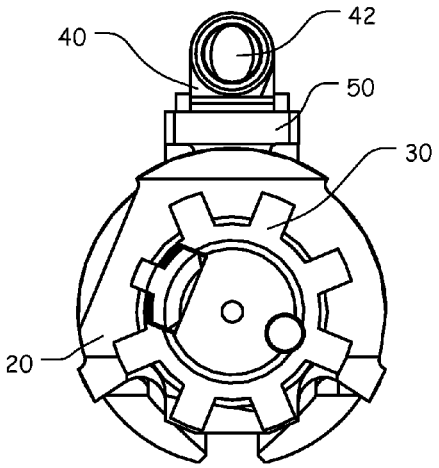
FIG. 3 PRIOR ART
FIG. 3 illustrates a front view of a standard bolt carrier group utilizing a standard cam pin, showing the cam pin and bolt in an unlocked position.
Figure 4:
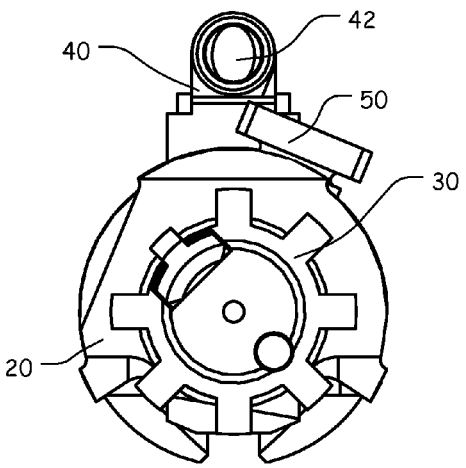
FIG. 4 PRIOR ART
FIG. 4 illustrates a front view of a standard bolt carrier group utilizing a standard cam pin, showing the cam pin and bolt in a locked position.
Figure 5:
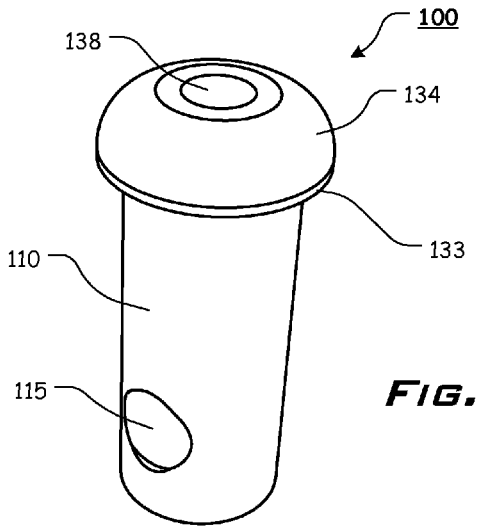
FIG. 5 illustrates an upper, front perspective view of an exemplary embodiment of an enhanced cam pin, according to the presently disclosed systems, methods, and/or apparatuses.
Figure 6:
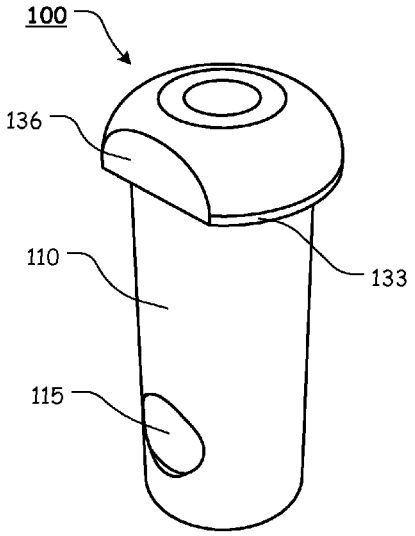
FIG. 6 illustrates an upper, rear perspective view of an exemplary embodiment of an enhanced cam pin, according to the presently disclosed systems, methods, and/or apparatuses.
Figure 7:
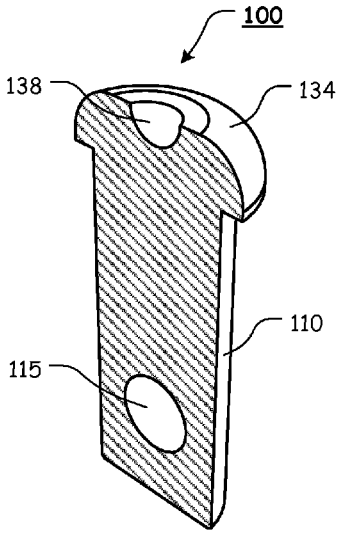
FIG. 7 illustrates a cross-sectional view taken along line 7-7 of the enhanced cam pin of FIG. 9.
Figure 8:
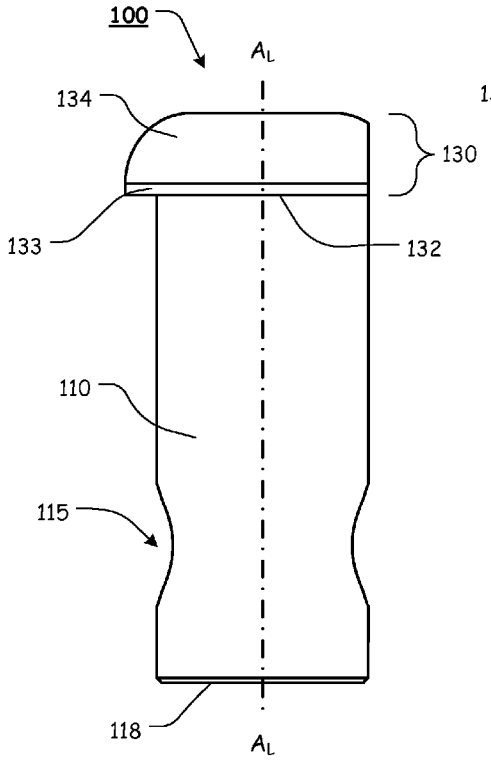
FIG. 8 illustrates a left, side view of an exemplary embodiment of an enhanced cam pin, according to the presently disclosed systems, methods, and/or apparatuses.
Figure 9:
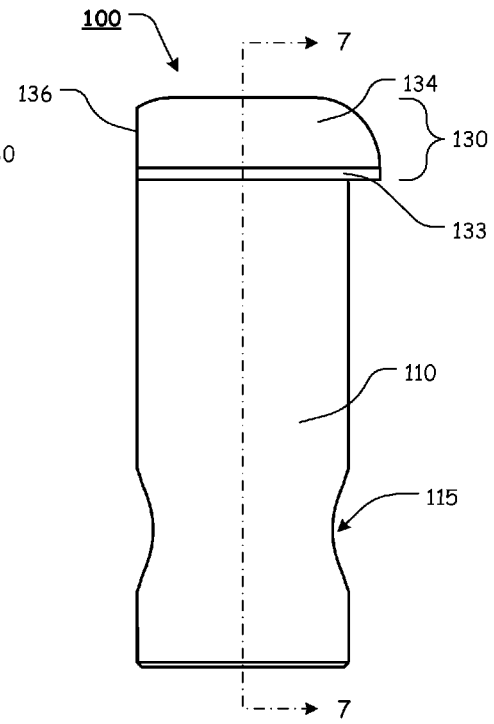
FIG. 9 illustrates a right, side view of an exemplary embodiment of an enhanced cam pin, according to the presently disclosed systems, methods, and/or apparatuses.
Figure 10:
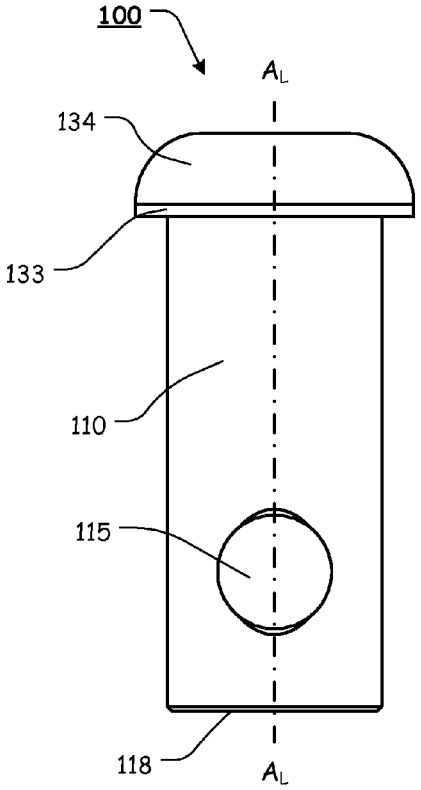
FIG. 10 illustrates a front view of an exemplary embodiment of an enhanced cam pin, according to the presently disclosed systems, methods, and/or apparatuses.
Figure 11:
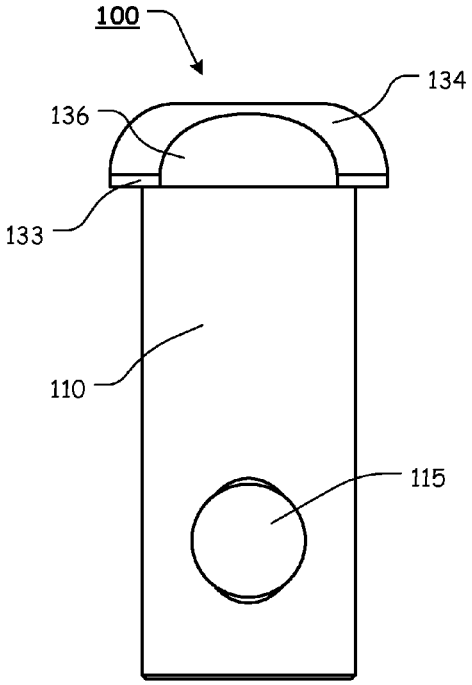
FIG. 11 illustrates a rear view of an exemplary embodiment of an enhanced cam pin, according to the presently disclosed systems, methods, and/or apparatuses.
Figure 12:
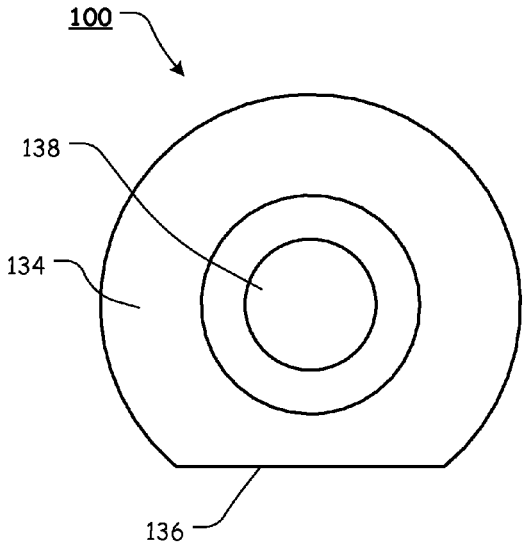
FIG. 12 illustrates a top view of an exemplary embodiment of an enhanced cam pin, according to the presently disclosed systems, methods, and/or apparatuses.
Figure 13:
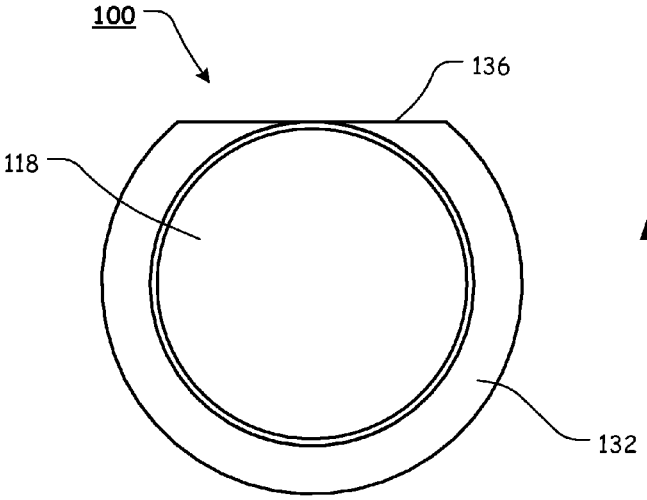
FIG. 13 illustrates a bottom view of an exemplary embodiment of an enhanced cam pin, according to the presently disclosed systems, methods, and/or apparatuses.
Figure 14:
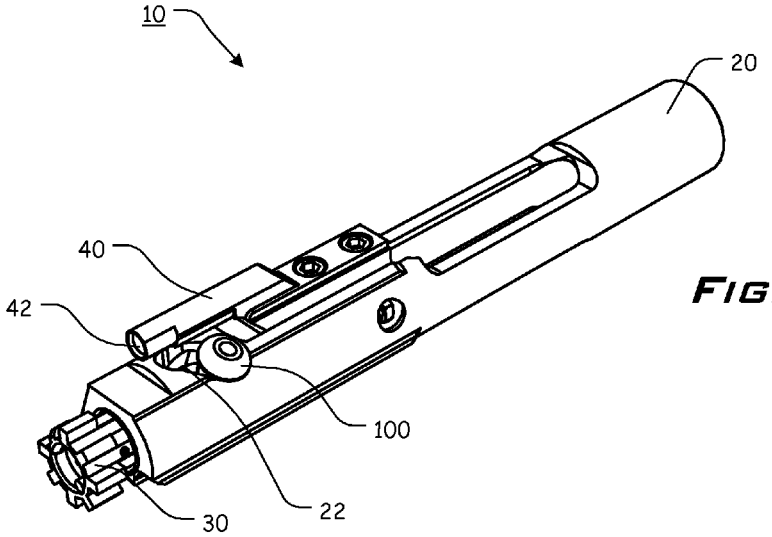
FIG. 14 illustrates a perspective view of a standard bolt carrier group utilizing an enhanced cam pin, according to the presently disclosed systems, methods, and/or apparatuses.

For simplicity and clarification, the design factors and operating principles of the cam pin according to the present disclosure are explained with reference to various exemplary embodiments of a cam pin according to the present disclosure. The basic explanation of the design factors and operating principles of the cam pin is applicable for the understanding, design, and operation of the cam pin, as disclosed herein. It should be appreciated that the cam pin can be adapted to many applications where a cam pin can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

It should also be appreciated that the terms "AR-15", "firearm", and "cam pin" are used for basic explanation and understanding of the operation of the systems, methods, and apparatuses of the present disclosure. Therefore, the terms "AR-15", "firearm", and "cam pin" are not to be construed as limiting the systems, methods, and apparatuses of the present disclosure.

For simplicity and clarification, the cam pins of the present disclosure will be described as being used in connection with a bolt carrier group 10 of an AR-15. However, it should be appreciated that these are merely exemplary embodiments of the cam pins and are not to be construed as limiting the present disclosure. Thus, the cam pins of the present disclosure may be utilized in connection with similar components of any firearm or device.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

Turning now to the appended drawing figures, FIGS. 1-4 illustrate certain elements and/or aspects of a known, exemplary AR-15 bolt carrier group 10 and standard cam pin 50.

It should also be appreciated that a more detailed explanation of the bolt carrier group 10 and standard cam pin 50, instructions regarding the use and operation of the bolt carrier group 10 and standard cam pin 50, and certain other items and/or techniques necessary for the implementation and/or operation of the standard cam pin 50 and bolt carrier group 10 are not provided herein because such background information will be known to one of ordinary skill in the art.

FIGS. 5-16 illustrate certain elements and/or aspects of an exemplary embodiment of the enhanced cam pin 100, according to the present disclosure. In illustrative, non-limiting embodiment(s) of the present disclosure, as illustrated in FIGS. 5-16, the enhanced cam pin 100 comprises at least some of a head element 130 and a shaft element 110.

The shaft element 110 extends from a terminal end surface 118, along a longitudinal axis $A_L$ of the enhanced cam pin 100, to a cam pin shoulder 132. In various exemplary embodiments, the cam pin shoulder 132 extends from the shaft portion perpendicular to a longitudinal axis $A_L$ of the enhanced cam pin 100.

A firing pin aperture 115 is formed through the cam pin shaft element 110. It should be appreciated that the size and positioning of the firing pin aperture 115 will be understood by one of ordinary skill in the art.

The head element 130 extends from the cam pin shoulder 132, along the longitudinal axis $A_L$, to a cam pin crown 134. A surface of the cam pin crown 134 is finished with a smooth surface or a substantially smooth surface. In various exemplary embodiments, the cam pin crown 134 extends directly from the cam pin shoulder 132 and presents a constant radius or varying radius, curved profile when viewed from the front, rear, or a side, as illustrated most clearly in FIGS. 8-11. It should be understood that the overall shape, profile, and/or geometry of the cam pin crown 134 is a design choice based, at least in part, on the desired appearance, strength, and/or functionality of the cam pin crown 134.

Figure 15:
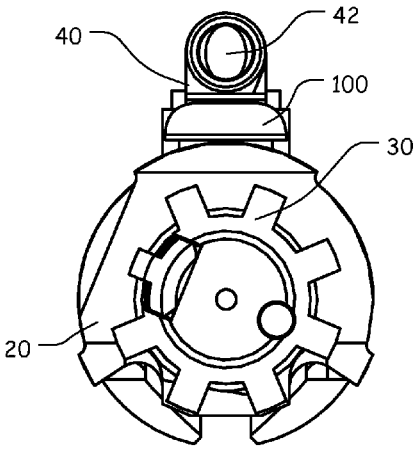
FIG. 15 illustrates a front view of a standard bolt carrier group utilizing an enhanced cam pin, according to the presently disclosed systems, methods, and/or apparatuses, showing the enhanced cam pin and bolt in an unlocked position.
Figure 16:
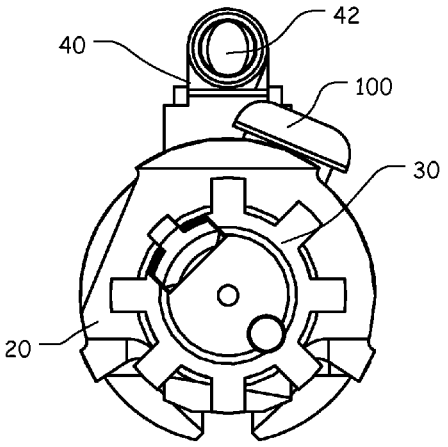
FIG. 16 illustrates a front view of a standard bolt carrier group utilizing an enhanced cam pin, according to the presently disclosed systems, methods, and/or apparatuses, showing the enhanced cam pin and bolt in a locked position.
Figure 17:
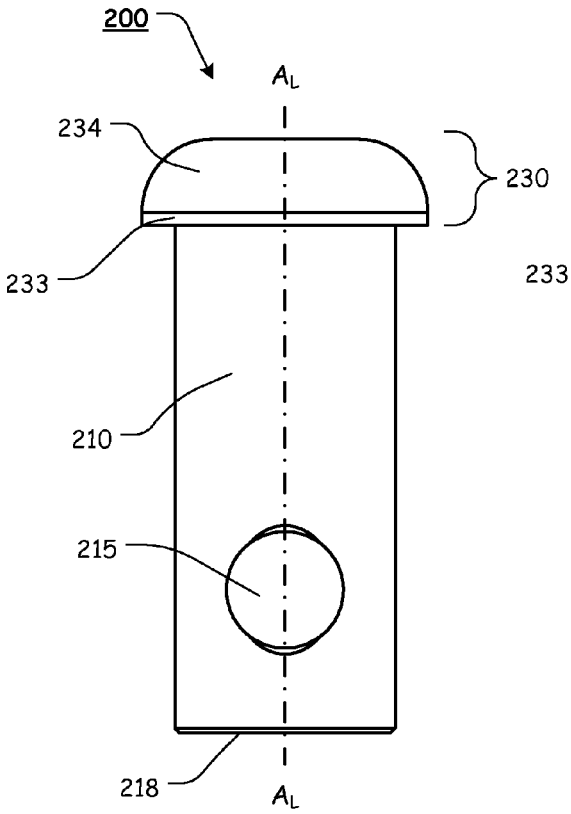
FIG. 17 illustrates a front view of an exemplary embodiment of an enhanced cam pin, according to the presently disclosed systems, methods, and/or apparatuses.
Figure 18:
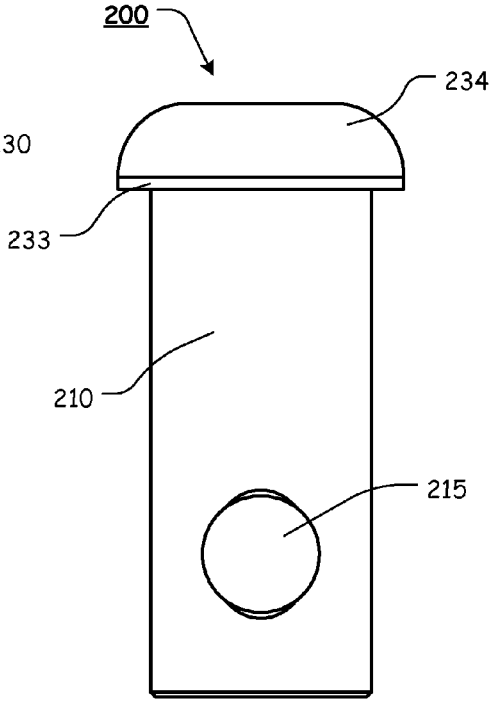
FIG. 18 illustrates a rear view of an exemplary embodiment of an enhanced cam pin, according to the presently disclosed systems, methods, and/or apparatuses.
Figure 19:
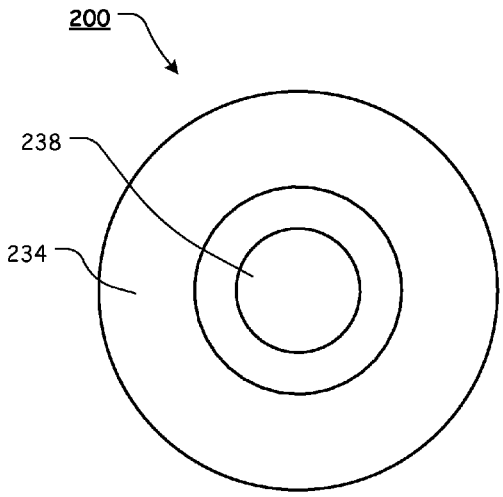
FIG. 19 illustrates a top view of an exemplary embodiment of an enhanced cam pin, according to the presently disclosed systems, methods, and/or apparatuses.
Figure 20:
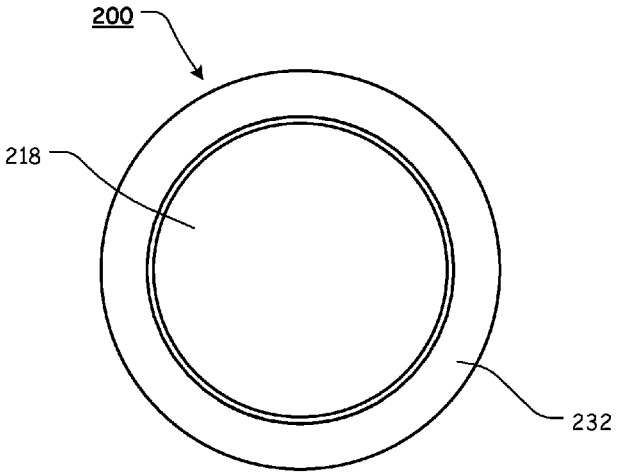
FIG. 20 illustrates a bottom view of an exemplary embodiment of an enhanced cam pin, according to the presently disclosed systems, methods, and/or apparatuses.

The cam pin crown 134 provides a domed, bulbous, or button shape to a terminating end portion of the head element 130. In this manner, the enhanced cam pin 100 does not present any hard edges as it transitions between an unlocked position and a locked position, as illustrated in FIGS. 15-16. Thus, as the components of the bolt carrier group are cycled through the firearm, the potential for the enhanced cam pin 100 to wear against an interior surface of the upper receiver is greatly reduced or eliminated.

In certain exemplary embodiments, the cam pin crown 134 may optionally comprise an indention or cam pin dimple 138 formed in the terminating end portion. Alternatively, the cam pin crown 134 may optionally comprise a recess, a planar surface, or merely a terminal surface or point (which would constitute a terminal end surface 118 of the head element 130).

A cam pin flat 136 is provided in a portion of the head element 130. A surface of the cam pin flat 136 is generally formed parallel to a longitudinal axis $A_L$ of the enhanced cam pin 100 and perpendicular to a longitudinal axis of the firing pin aperture 115. The cam pin flat 136, if included, provides additional clearance for the enhanced cam pin 100, relative to the bolt carrier key 40 of the bolt carrier group. Therefore, it should be appreciated that the overall size, shape, and positioning of the cam pin flat 136 is a design choice based upon compatibility with the components of the bolt carrier group and/or structures of a given upper receiver.

In certain exemplary embodiments, the cam pin shoulder 132 is spaced from the cam pin crown 134 and a head transition area 133 may optionally be formed or disposed between the cam pin shoulder 132 and cam pin crown 134 as a transition between the cam pin shoulder 132 and the cam pin crown 134. A surface of the head transition area 133 is substantially smooth and the head transition area 133 is formed perpendicular to the longitudinal axis $A_L$.

In certain exemplary embodiments, various components of the enhanced cam pin 100 are formed of steel. Alternate materials of construction of the various components of the enhanced cam pin 100 may include one or more of the following: stainless steel, aluminum, titanium, and/or other metals, as well as various alloys, combinations, and/or composites thereof. Thus, it should be understood that the material or materials used to form the enhanced cam pin 100 is a design choice based on the desired appearance, strength, and functionality of the enhanced cam pin 100.

FIGS. 17-20 illustrate certain elements and/or aspects of an exemplary embodiment of an enhanced cam pin 200, according to the present disclosure. As illustrated in FIGS. 17-20, the enhanced cam pin 200 includes at least some of a cam pin shaft element 210 extending along a longitudinal axis from a terminal end surface 218 to a cam pin shoulder 232, a firing pin aperture 215, a head element 230 comprising a cam pin crown 234 and an optional head transition area 233, and an optional cam pin dimple 238.

It should be understood that each of these elements corresponds to and operates similarly to the cam pin shaft element 110, cam pin shoulder 132, firing pin aperture 115, head element 130, cam pin crown 134, optional head transition area 133, and optional cam pin dimple 138, as described above with reference to the enhanced cam pin 100 of FIGS. 5-16.

However, as illustrated in FIGS. 17-20, the cam pin flat 236 is not included and the surface of the cam pin crown 234 (and optional head transition area 233) is unbroken. This version is particularly suited to applications wherein the firearm is a piston version and can accommodate a complete circle and the head element 230 does not have to include the face (or a cut) be inserted past the bolt carrier key.

Figure 21:
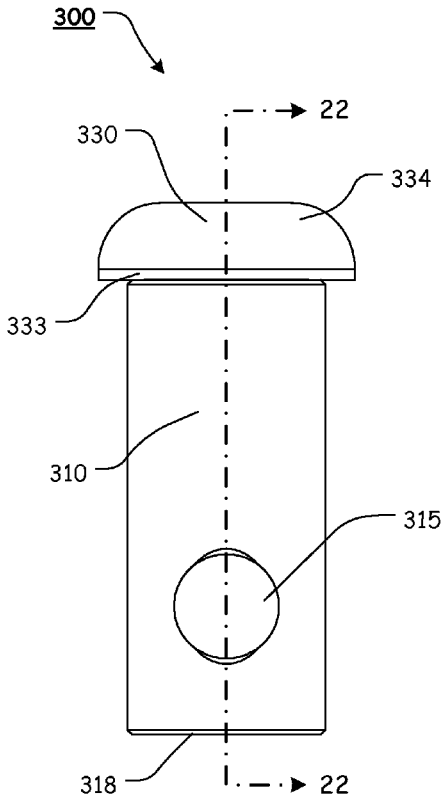
FIG. 21 illustrates a front view of an exemplary embodiment of an enhanced cam pin, according to the presently disclosed systems, methods, and/or apparatuses.
Figure 22:
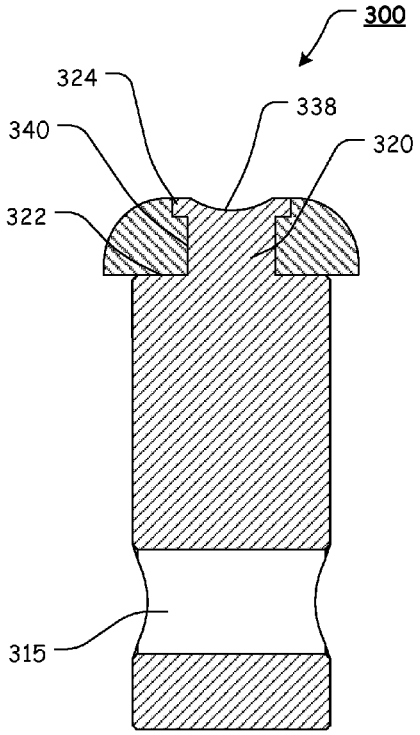
FIG. 22 illustrates a cross-sectional view taken along line 22-22 of the enhanced cam pin of FIG. 21.

FIGS. 21-22 illustrate certain elements and/or aspects of an exemplary embodiment of an enhanced cam pin 300, according to the present disclosure. As illustrated in FIGS. 21-22, the enhanced cam pin 300 comprises at least some of a head element 330 and a shaft element 310.

The shaft element 310 extends from a terminal surface, along a longitudinal axis $A_L$, to a recessed shelf 322. In various exemplary embodiments, the recessed shelf 322 extends into the shaft portion perpendicular to the longitudinal axis $A_L$ of the enhanced cam pin 300. The recessed shelf 322 extends inward to a cylindrical pivot shaft 320. The cylindrical pivot shaft 320 extends from the cylindrical shaft portion 310, along the longitudinal axis $A_L$, to a flange 324.

A firing pin aperture 315 is formed through the cam pin shaft element 310. It should be appreciated that the size and positioning of the firing pin aperture 315 will be understood by one of ordinary skill in the art.

The head element 330 extends from a terminal surface, along the longitudinal axis $A_L$, to a cam pin crown 334. The surface of the cam pin crown 334 is substantially smooth. In various exemplary embodiments, the cam pin crown 334 extends directly from the terminal surface and presents a constant radius or various radiused, curved profile when viewed from the front, rear, or a side, as illustrated most clearly in FIGS. 21-22. It should be understood that the overall shape, profile, and/or geometry of the cam pin crown 334 is a design choice based, at least in part, on the desired appearance, strength, and/or functionality of the head element 330.

In certain exemplary embodiments, the terminal surface is spaced from the cam pin crown 334 and a head transition area 333 may optionally be formed or disposed between the terminal surface and cam pin crown 334 as a transition between the terminal surface and the cam pin crown 334. A surface of the head element transition area is substantially smooth and the head element transition area is formed perpendicular to the longitudinal axis $A_L$.

A crown aperture 340 is formed through a center of the head element 330, along the longitudinal axis $A_L$. The crown aperture 340 is formed so as to correspond to the cylindrical pivot shaft 320.

The enhanced cam pin 300 is formed by seating the head element 330 atop the recessed shelf 322 of the shaft element 310, such that the head element 330 is able to freely spin or rotate atop the recessed shelf 322, via interaction of the pivot shaft 320 with the crown aperture 340. The flange 324 extends from the pivot shaft 320 and is larger than a diameter of the crown aperture 340, such that the head element 330 is maintained atop the shaft element 310. In various exemplary embodiments, the crown aperture 340 includes a recessed portion such that the flange 324 does not extend above the upper surface of the head element 330. Thus, the head element 330 acts as a roller atop the enhanced cam pin 300.

The cam pin crown 334 provides a domed, bulbous, or button shape to a terminating end portion of the head element 330. In this manner, the enhanced cam pin 300 does not present any hard edges as it transitions between an unlocked position and a locked position. Thus, as the components of the bolt carrier group are cycled through the firearm, the potential for the enhanced cam pin 300 to wear against an interior surface of the upper receiver is greatly reduced or eliminated.

In certain exemplary embodiments, the pivot shaft 320 may optionally comprise an indention or cam pin dimple 338 formed in the terminating end portion. Alternatively, the pivot shaft 320 may optionally comprise a recess, a planar surface, or merely a terminal surface or point (which would correspond to a terminal end surface 318 of the head element 330).

In certain exemplary embodiments, various components of the enhanced cam pin 300 are formed of steel. Alternate materials of construction of the various components of the enhanced cam pin 300 may include one or more of the following: stainless steel, aluminum, titanium, and/or other metals, as well as various alloys, combinations, and/or composites thereof. Thus, it should be understood that the material or materials used to form the enhanced cam pin 300 is a design choice based on the desired appearance, strength, and functionality of the enhanced cam pin 300. It should be appreciated that the head element 330 and the shaft element 310 may be formed of the same or different, suitable materials.

FIG. 22 illustrates a bottom view of a known upper receiver 80 for an AR-15 style rifle. The upper receiver 80 includes a standard rotation groove 82 and an abrupt rotation groove corner 84. A more detailed explanation of the elements of the known upper receiver are not provided herein because such background information will be known to one of ordinary skill in the art.

Figure 23:
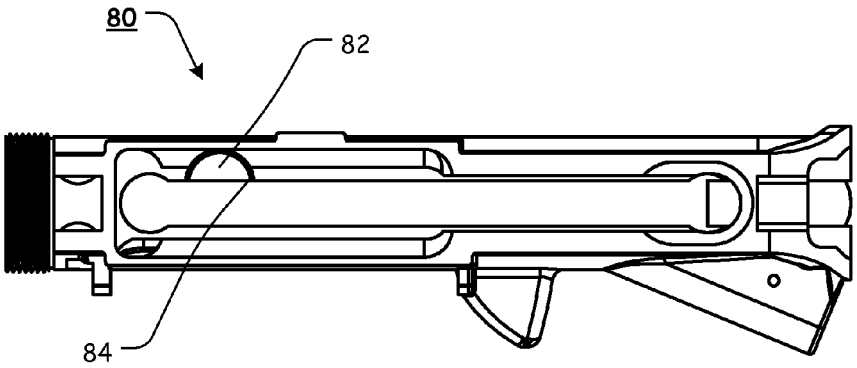
FIG. 23 PRIOR ART
FIG. 23 illustrates a bottom view of a standard upper receiver utilizing a standard cam pin relief cut or rotation groove and a standard rotation groove corner.
Figure 24:
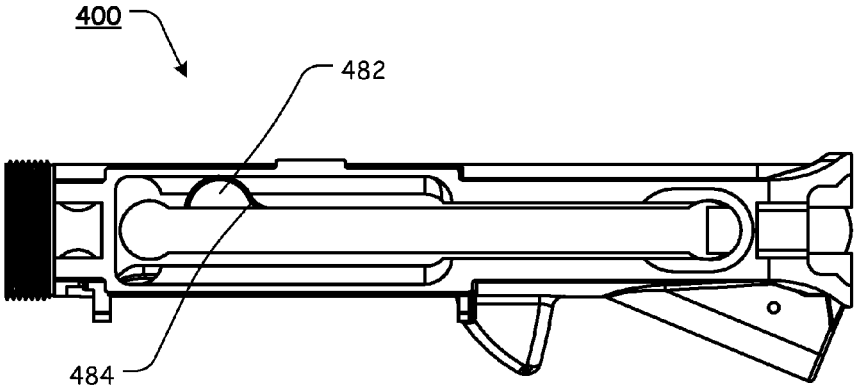
FIG. 24 illustrates a bottom view of an enhanced upper receiver utilizing an enhanced cam pin relief cut or rotation groove and an enhanced rotation groove corner, according to the presently disclosed systems, methods, and/or apparatuses.
Figure 25:
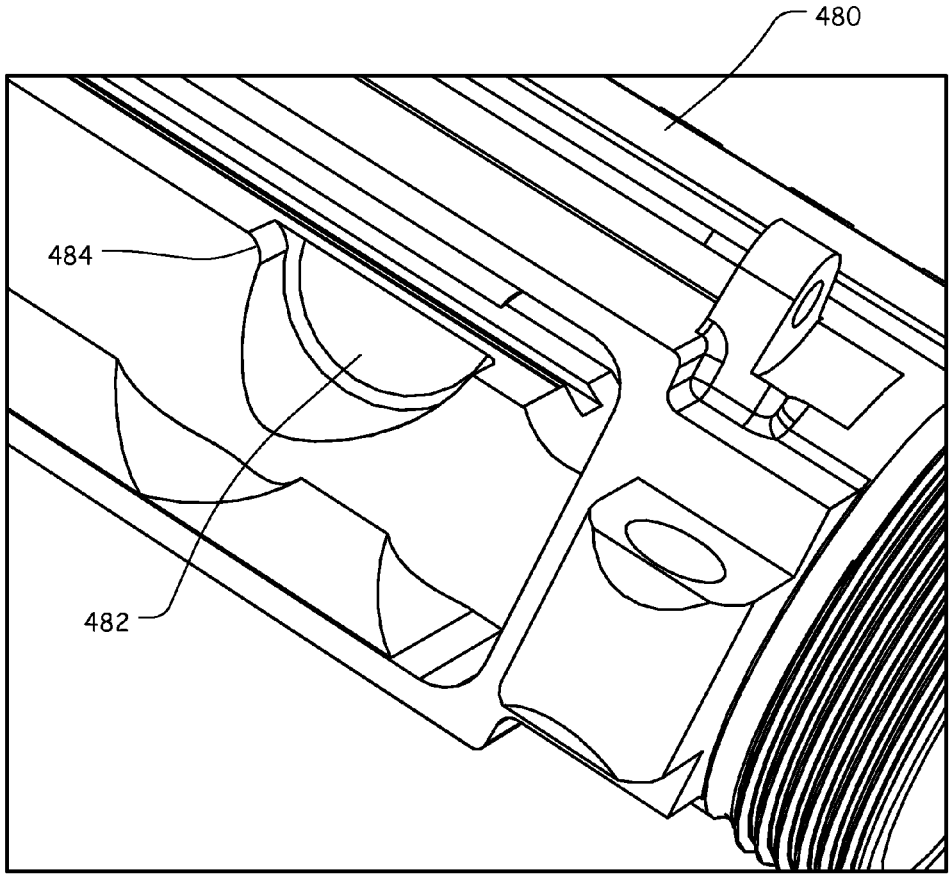
FIG. 25 illustrates a bottom, perspective view of an enhanced upper receiver utilizing an enhanced cam pin relief cut or rotation groove and an enhanced rotation groove corner, according to the presently disclosed systems, methods, and/or apparatuses.

FIGS. 23-24 illustrate certain elements and/or aspects of an exemplary embodiment of an enhanced upper receiver 400, according to the present disclosure. As illustrated in FIGS. 23-24, the enhanced upper receiver 400 comprises an enhanced cam pin relief cut or rotation groove 482 and an enhanced rotation groove corner 484. The enhanced cam pin rotation groove corner 484 is a radiused so as to provide a smooth transitional surface between the enhanced rotation groove 482 and the adjacent surfaces of the interior of the upper receiver 400.

The enhanced rotation groove 482 and enhanced rotation groove corner 484 allow the cam pin and bolt carrier group to achieve the required locking configuration with regard to the upper receiver, but provide a smooth transition surface and the bolt carrier group transitions from the locked position to the unlocked position.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A cam pin, comprising:

a cam pin shaft, wherein said shaft extends from a terminal end surface, along a longitudinal axis, to a shoulder;

a firing pin aperture formed through said cam pin shaft; and a head, wherein said head extends from said shoulder to a crown, wherein said head is formed as an integral portion of said cam pin shaft, and wherein a surface disposed between said shoulder and said crown is a continuous surface, having a constant radius, curved profile, wherein a cam pin flat is provided in a portion of said head, and wherein a surface of said cam pin flat is formed parallel to said longitudinal axis of said cam pin and perpendicular to a longitudinal axis of said firing pin aperture.

2. The cam pin of claim 1, wherein said shoulder extends from said cam pin shaft perpendicular to said longitudinal axis of said cam pin.

3. The cam pin of claim 1, wherein said crown extends directly from said shoulder and presents a constant radius curved profile.

4. The cam pin of claim 1, wherein said crown provides a domed, bulbous, or button shape to a terminating portion of said head.

5. The cam pin of claim 1, wherein said crown comprises an indention or dimple formed in a terminating end portion.

6. The cam pin of claim 1, wherein said shoulder is spaced from said crown and a head transition area is formed between said shoulder and said crown.

7. The cam pin of claim 6, wherein said head transition area is formed perpendicular to said longitudinal axis.

* * * * *